US006382928B1

(12) United States Patent
Chang

(10) Patent No.: US 6,382,928 B1
(45) Date of Patent: May 7, 2002

(54) MINIATURE AIR PUMP

(76) Inventor: Kun-Lin Chang, 3F, No. 22, Ho-Ping Rd., Pan-Chiao City, Taipei Hsien (TW)

( * ) Notice: Subject to any disclaimer, the term of this patent is extended or adjusted under 35 U.S.C. 154(b) by 0 days.

(21) Appl. No.: 09/722,561

(22) Filed: Nov. 28, 2000

(51) Int. Cl.[7] ..... F04B 1/12; F04B 27/08
(52) U.S. Cl. ..... 417/269
(58) Field of Search ..... 417/269, 270, 417/271, 272, 273

(56) References Cited

U.S. PATENT DOCUMENTS 3,857,243 A * 12/1974 Douglas ..... 417/269
4,347,778 A * 9/1982 Murray ..... 417/269
4,457,367 A * 7/1984 Brandell ..... 166/105
4,762,470 A * 8/1988 Wang ..... 181/264
4,801,249 A * 1/1989 Kakizawa ..... 417/269
5,074,765 A * 12/1991 Pekar ..... 36/29
5,104,298 A * 4/1992 Takahashi et al. ..... 310/17
5,626,464 A * 5/1997 Schoenmeyr et al. ..... 417/269
6,082,979 A * 7/2000 Friedman ..... 4/431

* cited by examiner

*Primary Examiner*—Teresa Walberg
*Assistant Examiner*—Daniel Robinson
(74) *Attorney, Agent, or Firm*—Rosenberg, Klein & Lee

(57) ABSTRACT

An elaborately designed miniature air compressor is composed of a motor unit, a compression unit, and an air collection unit. Several bladders installed in the compression unit are sequentially actuated by a compression vane with a thrust and pulling force imparted from priston like motion caused by revolution of an eccentrically installed follower rod such that air is continuously supplied to the air collection unit and ejected out of an air output port uniformly, stably, and adequately. Besides, all component units of the miniature air pump are combined together by two shackles in stead of using latch pins.

8 Claims, 9 Drawing Sheets

MINIATURE AIR PUMP

BACKGROUND OF THE INVENTION

1. Field of the invention

The present invention relates to a miniature air pump with an innovative structure, and more particularly, to a miniature air pump which can optionally choose the number of air bladders, and improve pump structure so as to stabilize the air output of the pump.

2. Description of the Prior Art

A conventional miniature air pump can only produce compressed air, and perform air intake and output function with a defined air chamber. Such a simply constructed miniature air pump often causes an unsmooth air flow due to its inherent shortcomings in the structural design.

For example, a well known conventional electronic sphy gmomanometer in the world requires installation of an outer check valve to refuse back flow of high pressure air into the pump so as to prevent measurement error.

SUMMARY OF THE INVENTION

It is an object of the present invention to provide a miniature air pump which can optionally choose the number of air chambers, and improve pump structure and function.

It is another object of the present invention to provide a miniature air pump which can be formed into a compact size and many pleasant contours for customers free choice.

It is still another object of the present invention to provide a miniature air pump whose bladders are able to sequentially output pressurized air from an air output hole after introducing the air into the pump via an air pathway, and also able to prevent the back flow of air with a membrane functioning as a check valve.

These and other objects of the miniature air pump according to the present invention comprises a motor unit, a compression unit, and an air collection unit.

Wherein, the motor unit further includes a main motor portion, a base, and a rotor portion. A rotating shaft which being extended out of the main motor portion tunnels through the base and is coupled with the rotor portion whereat an eccentric hole is provided. Several air inlet apertures are formed at the side of the base.

The compression unit further includes a compression vane, a fixture, and several compression chambers. A follower rod which being extended out of the center of the compression vane is inserted into the eccentric hole formed on the rotor portion with a predetermined offset angle. The compression chamber is composed of a bladder, a flow check membrane, and a leak proof gasket. Each compression chamber is conjoined with the compression vane by a tenon formed at the rear of each bladder mated with a corresponding mortise eye formed on the compression vane after tunneling through the fixture. A first check valve is installed on the fixture facing to the flow check membrane for each compression chamber.

The air collection unit has several flow pathways corresponding to the bladders, several membranes functioning as second check valves are equipped at each exit side of the flow pathway, several guide slots each formed between the first check valve and the bladder, and an air output port is formed at the topmost end thereof.

BRIEF DESCRIPTION OF THE DRAWINGS

To enable a further understanding of the innovative and technological content of the invention herein, refer to the detailed description of the invention and the accompanying brief description of the drawings appended below. Furthermore, the attached drawings are provided for purposes of reference and explanation, and shall not be construed as limitations applicable to the invention herein.

DETAILED DESCRIPTION OF THE PREFERRED EMBODIMENT

Figure 1:
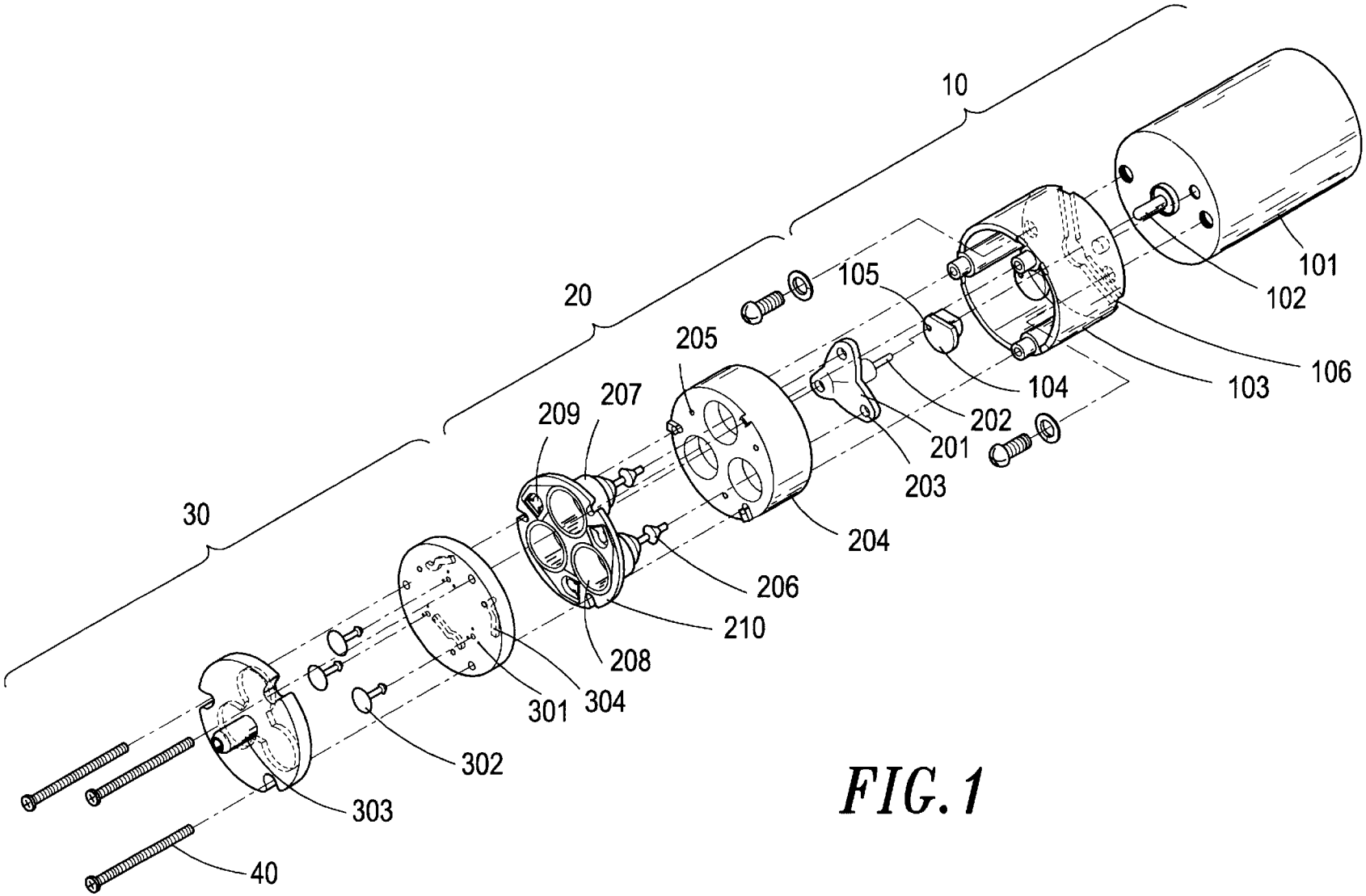
FIG. 1 is a three dimensional exploded view of the present invention.

Referring to FIG. 1, the three dimensional exploded view of the present invention shows that the contour of the miniature air pump is formed into a cylindrical configuration. The miniature air pump comprises a motor unit 10, a compression unit 20, and an air collection unit 30. Several latch pins 40 are applied from outside to conjoin all three aforementioned units together.

Figure 2:
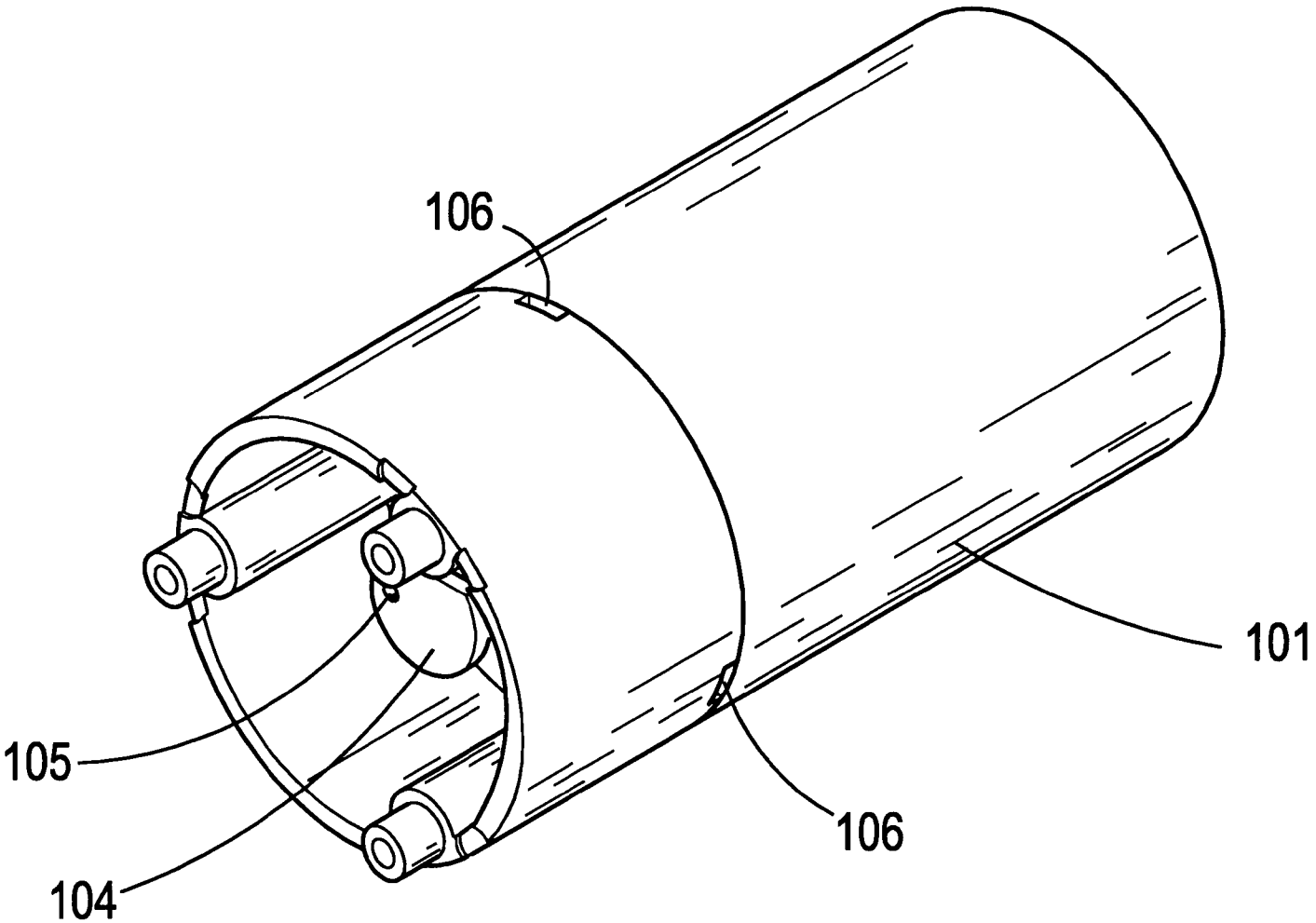
FIG. 2 is a schematic view of the motor unit of the present invention.

The motor unit 10 further includes a main motor portion 101, a base 103, and a rotor portion 104. FIG. 2 is its assembled view.

The compression unit 20 further includes a compression vane 201, a fixture 204, and several compression chambers 208. A follower rod 202 is extended from the center of the compression vane 201 and inserted into an eccentric hole 105 formed on the rotor portion 104 with a predetermined offset angle. The compression chamber 208 is composed of a bladder 207, a check flow membrane 209, and a leak proof gasket 210. In FIG. 1, three bladders disposed symmetrically apart from each other with 120° are used for improving compressed air output or particular requirement. The compression chambers 208 are conjoined with the compression vane 210 by tenons 206 each formed at the rear of respective bladder mated with corresponding mortise eye 203 formed on the compression vane 201 after tunneling through the fixture 204. A first check valve 205 is installed on the fixture 204 facing to the check flow membrane 209 for each compression chamber 208. The compression vane 201 is divided into three sub-blades each inclining upward with a predetermined angle.

The main motor portion 101 is engaged with its base 103, a rotating shaft 102 is extended out of the main motor portion 101, and after tunneling through the base 103, is coupled with the rotor portion 104. Several air inlet apertures 106 are formed at the side of the base 103. After the motor unit 10 is energized, the rotor portion 104 rotates rapidly along with the follower rod 202 which being inserted into the eccentric hole 105. Several steel balls are provided in the eccentric hole 105 for preventing excessive abrasion of the follower rod 202 caused by friction.

Figure 3:
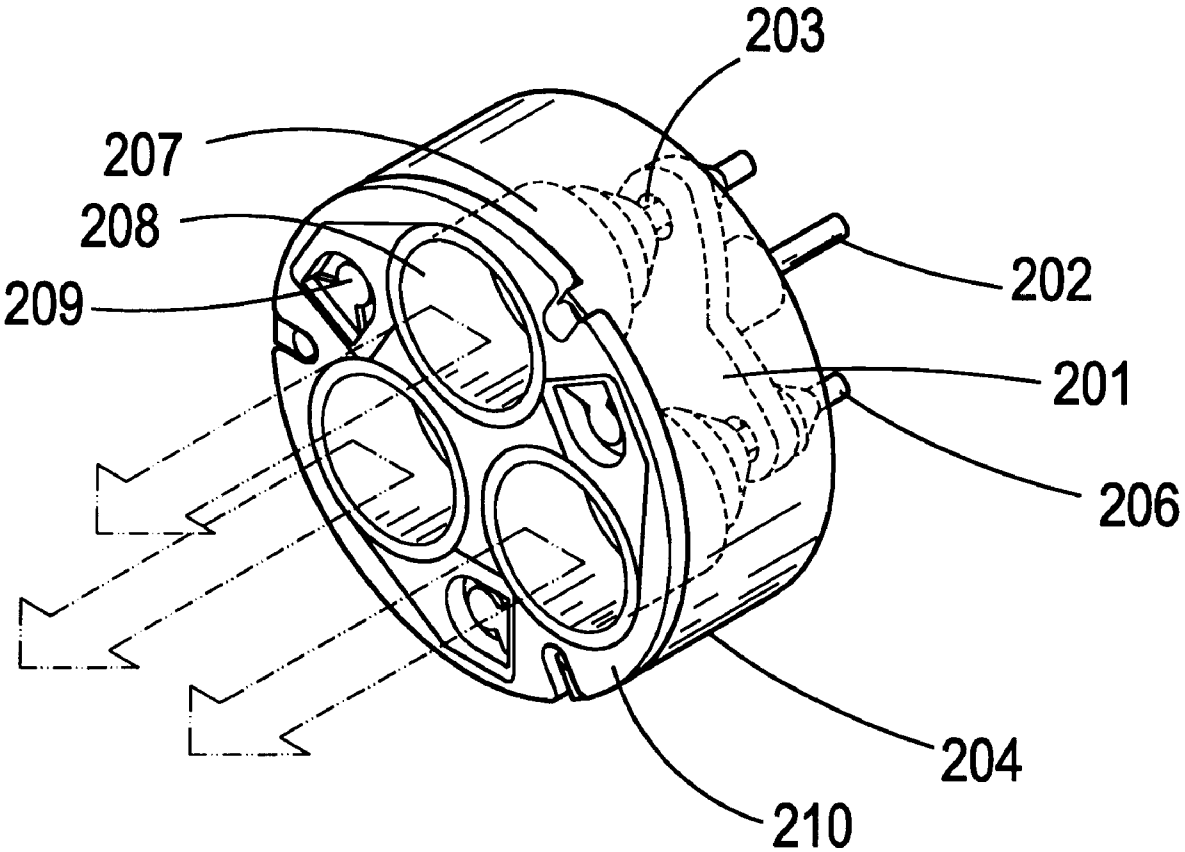
FIG. 3 is a schematic view of the compression unit of the present invention.

Referring to FIG. 3, this drawing shows the assembled view of the compression unit in which the follower rod 202 has been already inserted into the eccentric hole 105 of the rotor portion 104. The follower rod 202 revolves eccentially by the motor unit 10 and drives the compression vane 201 to rotate which in turn sequentially equesszes all bladders 207 with a thrust force imparted from the follower rod. The bladders 207 then supplies the produced air into the air collection unit 20. With such structure and the aid of the friction reducing steel balls in the eccentric hole 105, the driving power can be saved a great deal.

Figure 4:
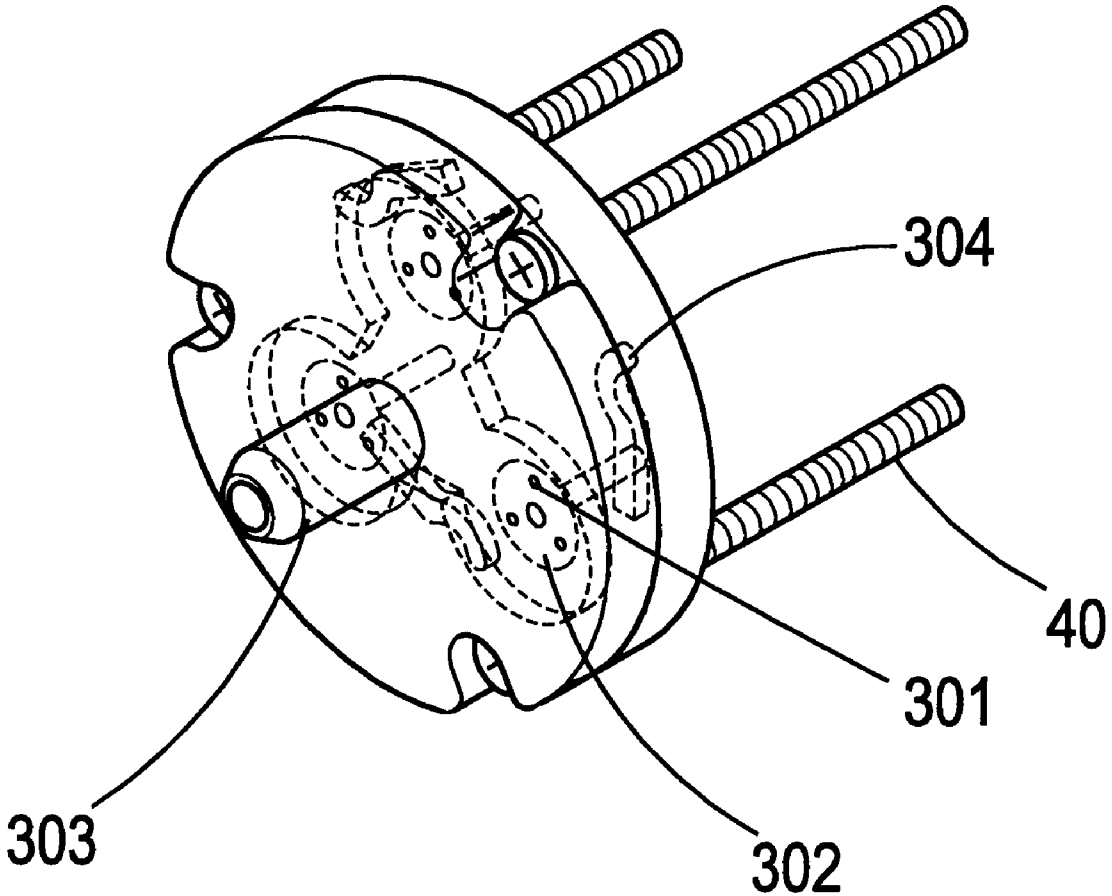
FIG. 4 is a schematic view of the collection unit of the present invention.
Figure 7A:
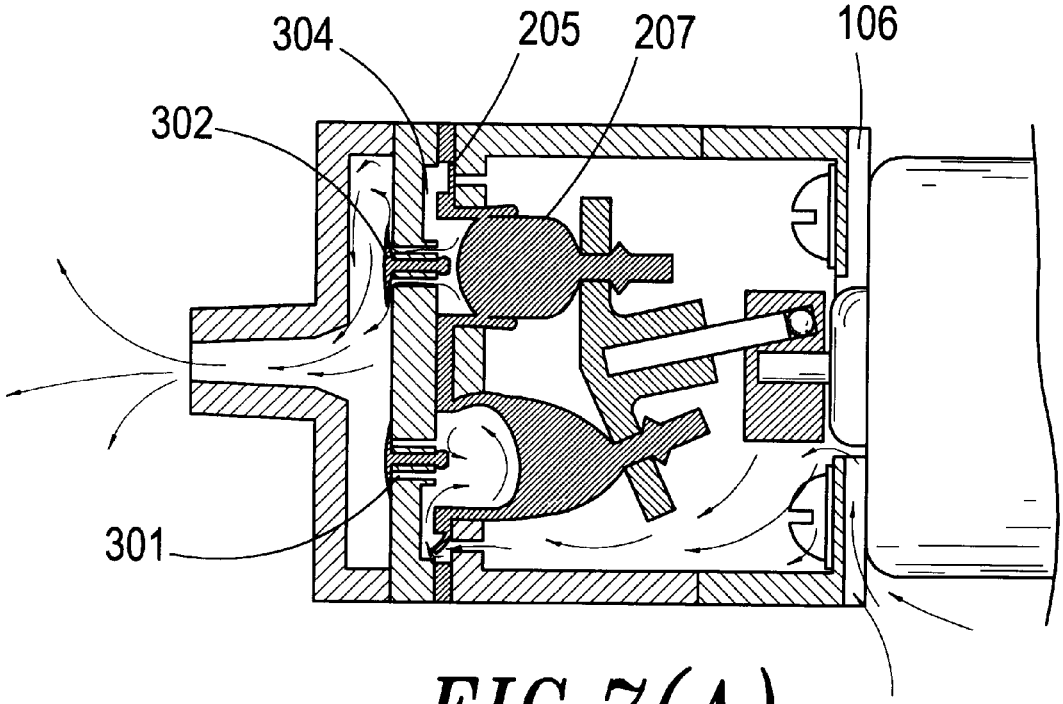
FIGS. 7A to 7B are drawings illustrating operational principle in the miniature air pump of the present invention.
Figure 7B:
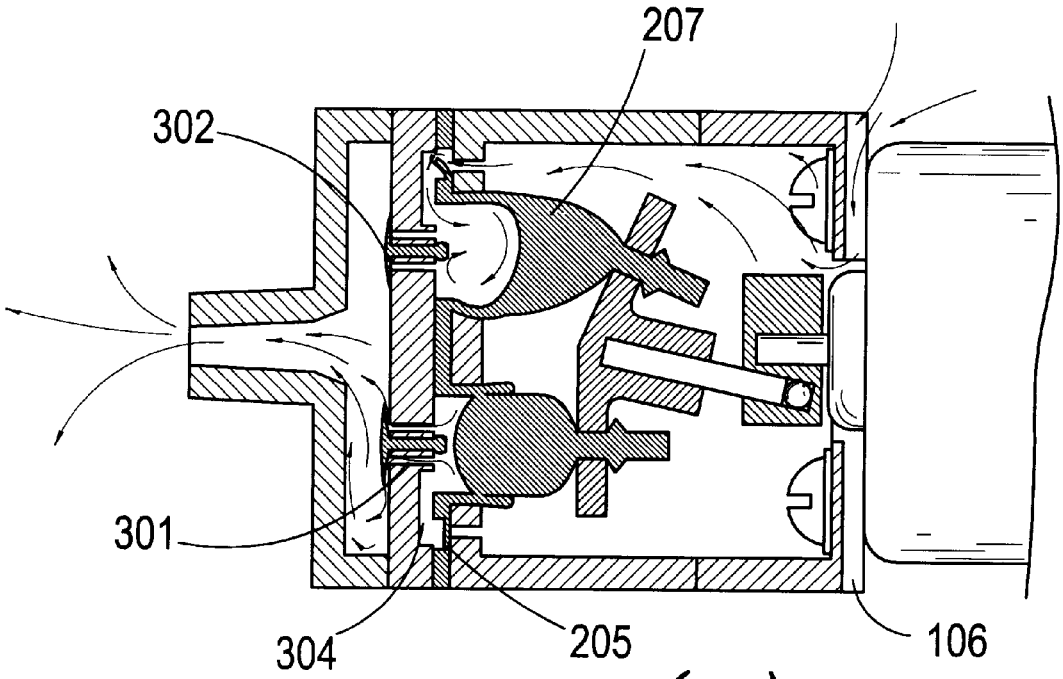

For more detailed description about the operational principle of the present invention, reference should be made to FIGS. 7A and 7B together with FIGS. 3 and 4. FIGS. 7A and 7B illustrate operational principle of a two-bladder pump of the present invention. In the state shown in FIG. 7A, the upper bladder 207 is in full state, the upper first valve 205 is closed by inner pressure of the upper compression chamber 208, and this same pressure forces the upper flow check membrane 302 to open and from a pathway 301 around its periphery such that air stored in the upper comprission chamer 208 is supplied to the air collection unit 30 therethrough and ejected out of the air output hole 303. On the other hand, the lower bladder 207 is in squeezed and deformed state, the reduced inner pressure of the lower compression chamber 208 causes the lower first check valve 205 to open and allows the outside air to flow into the lower compression chamber 208 via the plurality of air inlet apertures 106. On the other hand, in FIG. 7B, an exactly reversed state to that of FIG. 7A happens. Such motions are alternatively and repeatedly continued until the motor unit 10 stops driving the compression vane 201.

By successively and sequentially squeezing all bladders 207 one by one, the air can continuously flow through the pathway 301 and is uniformly ejected out of the air output port 303. The membrane 302 can function as a check valve to prevent back flow of air from the pathway 301.

Figure 5:
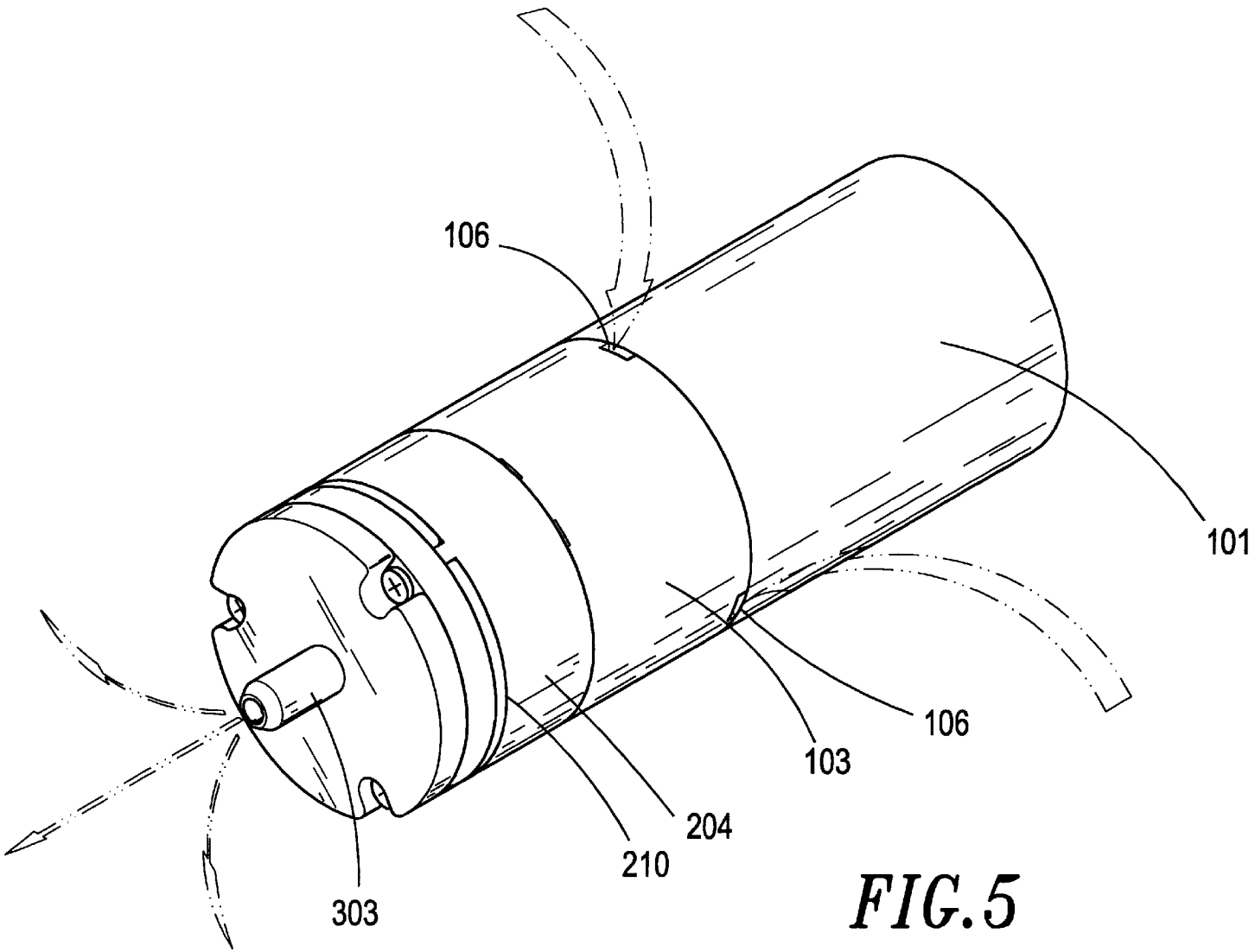
FIG. 5 is an assembly view of the miniature air pump of the present invention.
Figure 6A:
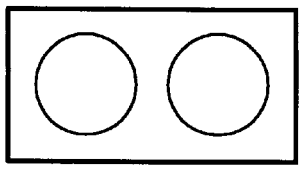
FIGS. 6(A) to 6(D) drawings illustrating various kinds of planar views whereby a compression chamber is configurated in the miniature air pump of the present invention.
Figure 6B:
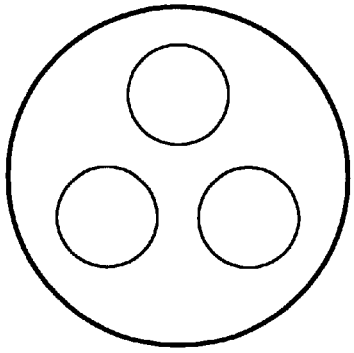
Figure 6C:
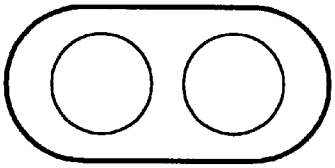
Figure 6D:
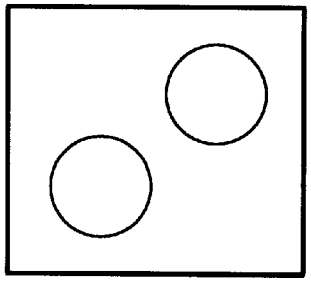

Referring to FIG. 5 the miniatuture air pump after assembling is engaged with several latch pins 40 from outside. The leak proof gasket 210 interposed between the compression unit 20 and the air collection unit 30 may preserve a constant pressure inside the pump and maintain a stable amount of air output as well.

Figure 9:
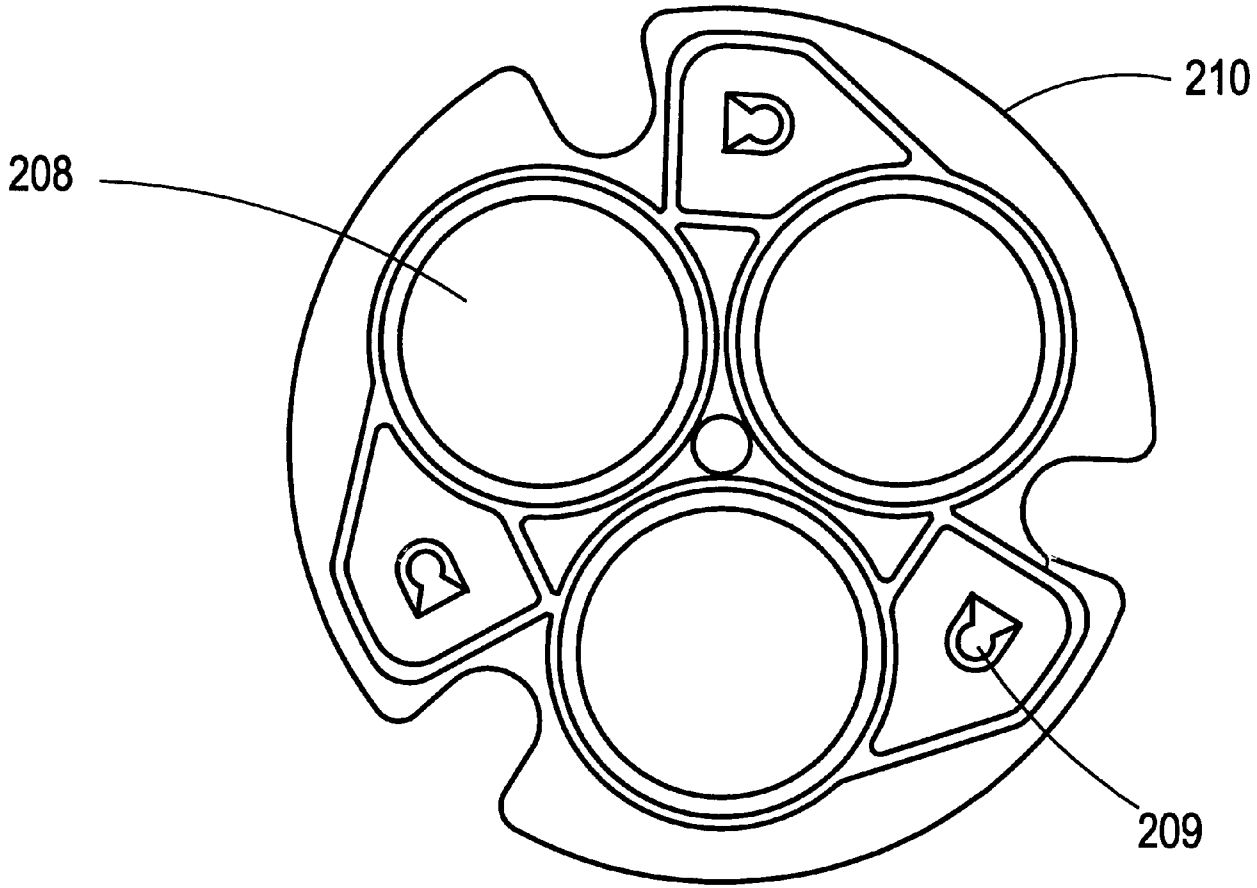
FIG. 9 is a plan view illustrating relative positions among the compression chamber, the leak proof gasket, and the check flow membrane.

According to operational principles described above, any number of bladders and any forms of arrangement for the bladders are optionally applicable as long as the compression chambers may be symmetrically disposed as shown in FIG. 9. In FIG. 9, relative positions among the compression chamber 208, the leak proof gasket 210, and the flow check membrane are shown in a plan view. As it is clearly shown, each compression chamber 208 is disposed 120° apart from the adjacent one so that the arrangement fulfils the aforesaid principles of uniformity and symmetry. Besides, referring to FIGS. 6A through 6D, two or more than two bladders are employed with a contour configurated in square, ellipse, circle, or rectangle in planar view. Other corresponding parts can be designed to match for.

Figure 8B:
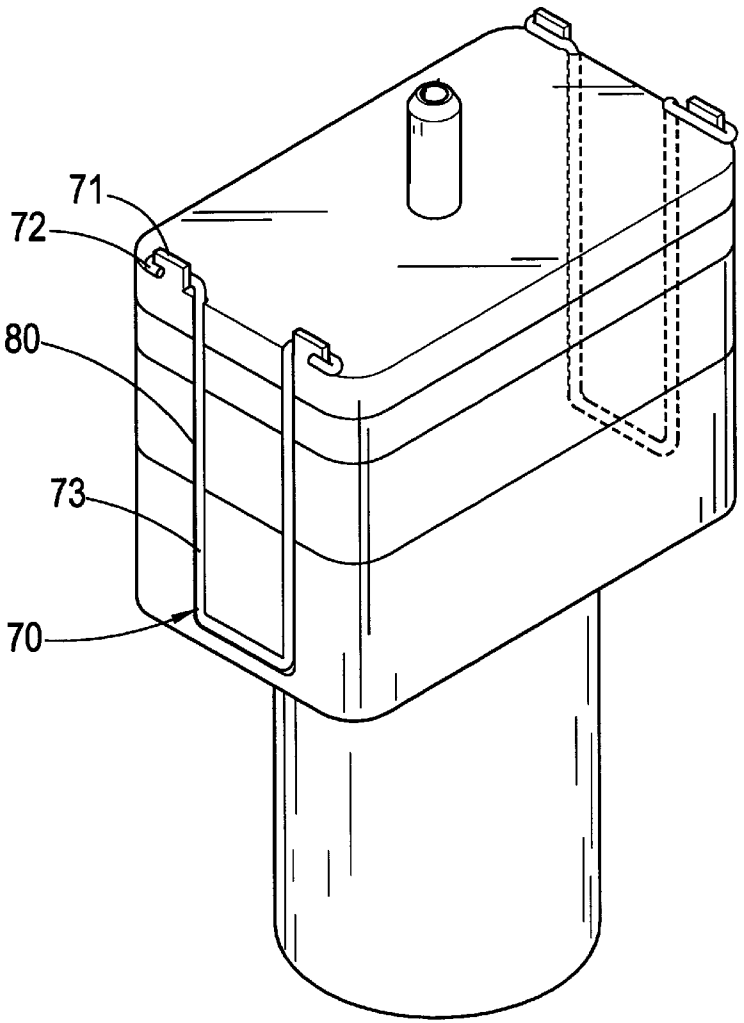
FIGS. 8A and 8B are illustrating two different types of latching means used for conjoining all three units of the present invention together.
Figure 8A:
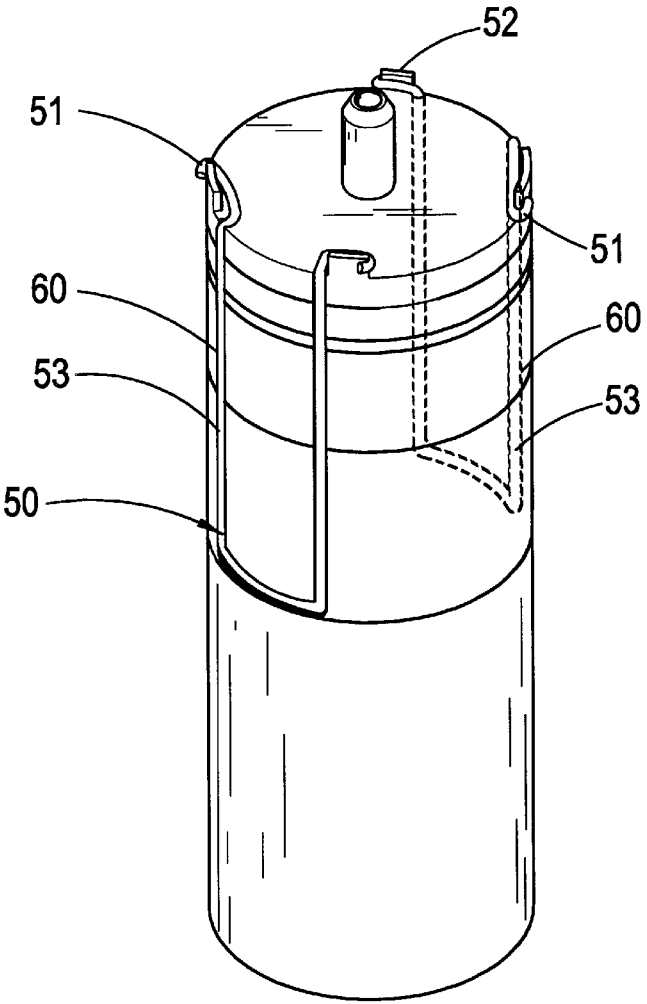

Finally, referring to FIG. 8A, for achieving pinless construction, a pair of U shaped shackles 50 are used to combine all units of the present invention together. Two hooks 51 flexed in opposite direction are stretched from two ends of the shackle 50 to hook respectively on two hasps 52 formed on the rim of the top surface of the assembly. In this way the component units of various sizes and shapes can be engaged together with two U shaped shackles 50. FIG. 8A shows two U shaped shackles 50 are used to engage all three units of a cylindrical pump together by inlaying two shackle bodies 53 in the grooves 60 formed on the outer surface of the assembly. Similarly, FIG. 8B shows two U shaped shackles 70 are used to engage all three units of a pump formed in a rectangular prismatic contour by inlaying two shackle bodies 73 in the grooves 80 formed on the outer surface of the assembly, and engaging hooks 71 with the hasps 72 in similar way as that of FIG. 8A.

From the above detailed description of the present invention, it will be clear that the miniature air pump according to the present invention has many advantages that the number of air chambers is optionally selective to form the pump structure into a compact size and many pleasant contours, and also can improve the pump function to supply compressed air stably and with a uniform flow.

Other embodiments of the present invention will become obvious to those skilled in the art in light of above disclosure. It is of course also understood that the scope of the present invention is not to be determined by the foregoing description, but only by the following claims.

What is claimed is:

1. A miniature air pump comprising a motor unit, a compression unit, and an air collection unit;

Wherein, said motor unit further including a main motor portion, a base, and a rotor portion, a rotating shaft which being extended out of said main motor portion is tunneling through the base and is coupled with said rotor portion whereat an eccentric hole being provided; several air inlet apertures is formed at the side of said base;

Said compression unit further including a compression vane, a fixture, and several compression chambers, a follower rod which being extended out of the center of said compression vane is inserted into said eccentric hole formed on said rotor portion with a predetermined offset angle, said compression chamber being composed of a bladder, a flow check membrane, and a leak proof gasket, said compression chambers are conjoined with said compression vane by tenons each formed at the rear of rear of respective bladder mated with a corresponding mortise eye formed on said compression vane after tunneling through said fixture, a first check valve is installed on said fixture facing to said flow check membrane for each compression chamber;

Said air collection unit including several flow pathways corresponding to said bladders, several membranes functioning as second check valves equipped at each outer side of said flow pathway, several guide slots each formed between said first check valve and said bladder, and an air output port at the topmost end thereof;

With this structure, being driven by said motor unit, said compression vane is rotated by said follower rod and applies sequentially all bladders with a thrust and a pulling force imparted from said eccentrically installed follower rod, when one of said bladders is in full state, said first check valve is tightly closed by inner pressure of said compression chamber, while said flow check membrane functioning as a second check valve is opened by inner pressure of said corresponding compression chamer, and the stored air is introduced to said air collection unit, as soon as said full bladder is deformed, said first check valve is opened to input new air into said bladder via said guide slot, while said flow check, membrane is closed by a negative inner pressure thereof, such repeated actions are continued as long as said motor unit is energized, and air is therefore continuously and uniformly filled into said air collection unit and is ejected out of the pump from said air output port, said pump is characterized in that the number of said bladders and corresponding parts is optionally selective, and said bladders can be symmetrically disposed in various configuration.

2. The miniature air pump of claim 1, wherein the number of said bladder is two or more than two.

3. The miniature air pump of claim 1, wherein the contour of said pump is configurated in a square column, a elliptic cylinder, a circular cylinder, or a rectangular column.

4. The miniature air pump of claim 1, wherein said compressive vane actuates said bladders sequentially during rotation with a thrust and pulling force imparted form piston like motion caused by revolution of said eccentrically installed follower rod such that air is continuously supplied to said air collection unit.

5. The miniature air pump of claim 1, wherein power consumption of said motor unit is saved by conjoining said compression vane can said rotor portion with said follower rod which is inserted into the eccentric hole formed on said rotor portion, and several steel balls are equipped in said eccentric hole to reduce the friction of rotation.

6. The miniature air pump of claim 1, wherein all component units of said pump assembly can be engaged tightly with several shackles in stead of using latch pins, each said shackle is characterized in that it has two hooks flexed in opposite direction and is formed at both ends thereof.

7. The miniature air pump of claim 1, wherein said several air inlet apertures can be formed optionally at any side of said motor unit.

8. The miniature air pump of claim 1, wherein said compression vane is divided into three sub-blades each inclining upward with a predetermined angle.

* * * * *